United States Patent [19]

Bock

[11] Patent Number: 4,821,442

[45] Date of Patent: Apr. 18, 1989

[54] CENTER FEED MAGAZINE FOR FIREARMS

[76] Inventor: Robert T. Bock, Rd6 Drovers La., Brewster, N.Y. 10509

[21] Appl. No.: 109,992

[22] Filed: Oct. 19, 1987

[51] Int. Cl.[4] ..... F41C 25/06

[52] U.S. Cl. ..... 42/17; 42/49.01

[58] Field of Search ..... 42/6, 17, 49.01

[56] References Cited

U.S. PATENT DOCUMENTS

| | | | |
|---|---|---|---|
| 316,554 | 4/1885 | Marlin . | |
| 869,484 | 10/1907 | Drake . | |
| 2,482,398 | 9/1949 | Blanton et al. . | |
| 3,373,520 | 3/1968 | Into . | |
| 3,474,560 | 10/1969 | Ramsay . | |
| 3,665,631 | 5/1972 | Dominian et al. | 42/17 |
| 3,755,948 | 9/1973 | Heinicke | 42/17 |
| 4,509,284 | 4/1985 | Naber | 42/87 |

*Primary Examiner*—Deborah L. Kyle
*Assistant Examiner*—Richard Klein

[57] ABSTRACT

A tubular magazine for storing and feeding a large volume of cartridges into the receiver of a firearm. The magazine comprises a plurality of magazine sections having means to urge cartridges toward the receiver, and a connecting member joining the magazines to each other and to the receiver of the firearm.

6 Claims, 3 Drawing Sheets

CENTER FEED MAGAZINE FOR FIREARMS

BACKGROUND-FIELD OF INVENTION

This invention relates to firearm magazines. More particularly the invention is concerned with apparatus facilitating the storing of large volume of cartridges within the tubular magazine type firearms.

BACKGROUND-DESCRIPTION OF PRIOR ART

Heretofore firearms with tubular magazines have positioned the magazines either under the barrel, or in the stock, having the magazine terminate at the receiver. The magazine fed the cartridges through their end into the receiver, and their capacity has been limited by the length of the barrel or the stock.

The problem of the insufficient capacity of the tubular magazines particularly manifested itself in shotguns that are used in military and/or police applications.

Prior attempts to improve this art have only been partially successful. Extending barrels and the magazines under them causing logistic problems carrying the firearms in vehicles. The advantage of the shotgun in close quarters fighting is being negated by the difficulty of handling a long barreled shotgun inside of structures.

The attempt to increase firepower by the adoption of a speed loader also presents disadvantages for the combatants. The reloading operation requires the removal of the shotgun from the shoulder of the user. It requires close visual attention to the loading operation, therefore the use of the speed loader in dark is very difficult. It will also jam the gun if reloading of a partially empty magazine is attempted.

Most military and police organizations would find it desirable to have a weapon with increased firepower capability, fitting within the customary size restriction imposed by tactical and logistical considerations.

OBJECTS AND ADVANTAGES OF THE INVENTION

Responding to the above described needs, this invention provides a firearm magazine of increased cartridge storage capacity within the envelope of a customary barrel, receiver and stock configuration firearm. The magazine extends from the end of the barrel through the receiver to the end of the stock. It has means of dispensing cartridges from its middle section into the receiver, therefore effectively doubling the storage capability of a comparable size firearm.

An object of this invention is to provide an improved structure for increased storage and firepower capability of tubular magazine structured firearms.

An other object of this invention is to provide a magazine that is easily and rapidly reloadable in dark, without visual attention, by singular or plurality of cartridges.

A further object is to provide means of speed loading capability by one hand, by way of providing a positive alignment chamber within the tubular magazine structure for a removable clip particularly suitable for shotgun cartridges.

A particular object of this invention is to maintain multiple cartridge firing capability of the firearm even during the reloading process.

An alternative object of the invention is to provide means for designing a reduced overall length firearm for a given magazine capacity.

It is also an object to develop a tubular magazine for firearms allowing the firearms to be designed for improved controlability during firing and faster recovery time for successive shots.

Further objects and advantages will appear to those skilled in the art from the following, considered in conjunction with the accompanying drawings.

DRAWINGS

In the accompanying drawings, in which certain modes of carrying out the present invention are shown for illustrative purposes:

DRAWING REFERENCE NUMERALS

Figure 1:
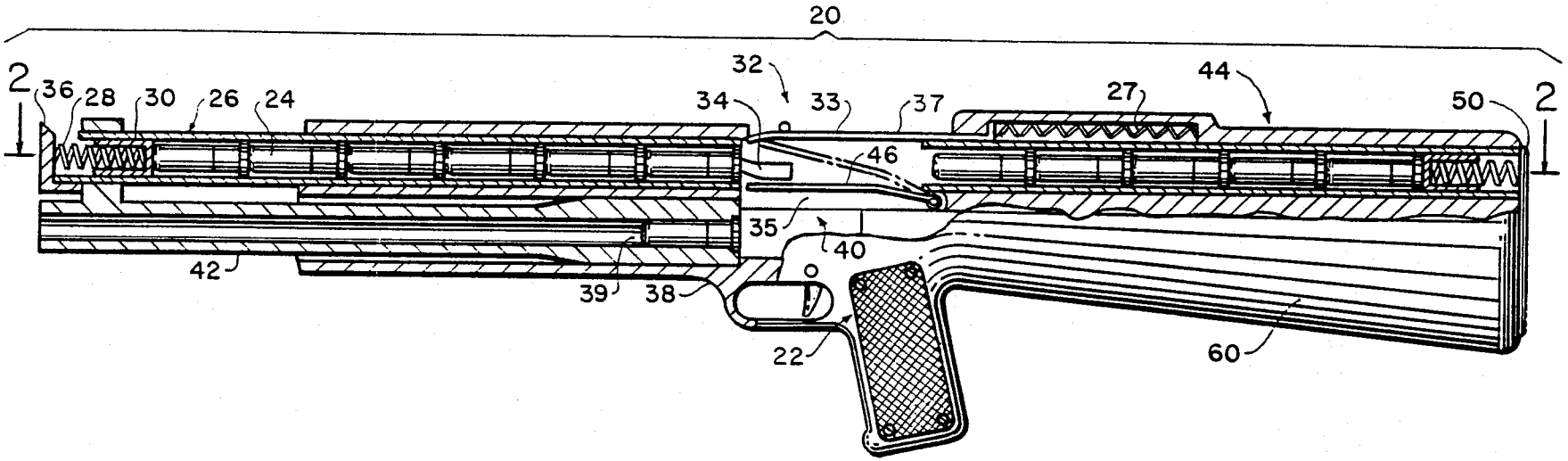
FIG. 1 shows a longitudinal cross sectional view of the invention in the centrally loadable configuration. It is shown in a built in configuration as an integral part of a shotgun.

20:Center feed magazine-general view.
22:Shotgun
24:Cartridges
25:Cartridge Rim
26:Main magazine section
27:Spring
28:Main magazine spring
29:Auxiliary magazine spring
30:Cartridge follower, main magazine
31:Cartridge follower, auxiliary magazine
32:Center magazine section
33:Top opening
34:Retainer
35:Bottom opening
36:Cap
37:Sliding cover
38:Receiver
39:Firing chamber
40:Bolt
42:Barrel
44:Auxiliary magazine section
46:Deflector-commonly called carrier in prior art
48:Abutment
50:Buttplate
52:Charging handle-spring returnable
53:Charging handle-manually operated
54:Return spring
55:Release button
56:Tubular insert
57:Catcher, spring steel
58:Recess in stock
59:Retainer pin
60:Stock
61:Pivoting pusher
62:Pusher
63:Spring for pivoting pusher
64:Charging handle-clip magazine type
65:Slot in clip 66:Slot
67:Slot
68:Pin
69:Flared recess in center magazine section
70:Finger recess
71:Flared recess in auxiliary magazine section
72:Cam surface
73:Recess for cartridge detent in clip
74:Clip
75:Spring for clip release
76:Clip Catcher
77:Thumb recess
78:Flared opening
79:Retainer
80:Housing
81:Cap
82:Follower
83:Spring
84:Slot
85:Hole
86:Flared end

THE PREFERRED EMBODIMENT

Description

FIG. 1, FIG. 2, FIG. 3, FIG. 4 and FIG. 5 show the preferred embodiment of the invention. The center feed magazine generally shown at 20, built as an integral part of a shotgun 22 joining and forming the upper part of the receiver 38 and joining and forming the upper part of the stock 60.

The magazine 20 is positioned above the barrel 42, allowing a lower position for the barrel 42 in relationship to the other components of the shotgun 22, and particularly the stock 60. This lower position of the barrel 42 causes the recoil to be absorbed in a straight line against the user's shoulder and thereby reducing the lifting effects of the recoil. The reduced lifting effect provides improved controlability during firing and faster recovery time for successive shots.

The magazine system 20 comprises:

A main magazine section 26 shown in FIG. 1, being made of tubular construction having a spring 28 loaded cartridge follower 30 that urges the cartridges 24 toward the center magazine section 32. The cartridges 24 being stopped by a single or plurality of retainers 34. The retainers 34 being part of the receiver 38, arranged according to prior art in such a way that only one cartridge 24 is being allowed to progress from the main magazine section 26 into the center magazine section 32 for each cycle of the bolt 40. The main magazine section 26 is closed on the external end by a cap 36 or other means to retain the spring 28.

Figure 2:
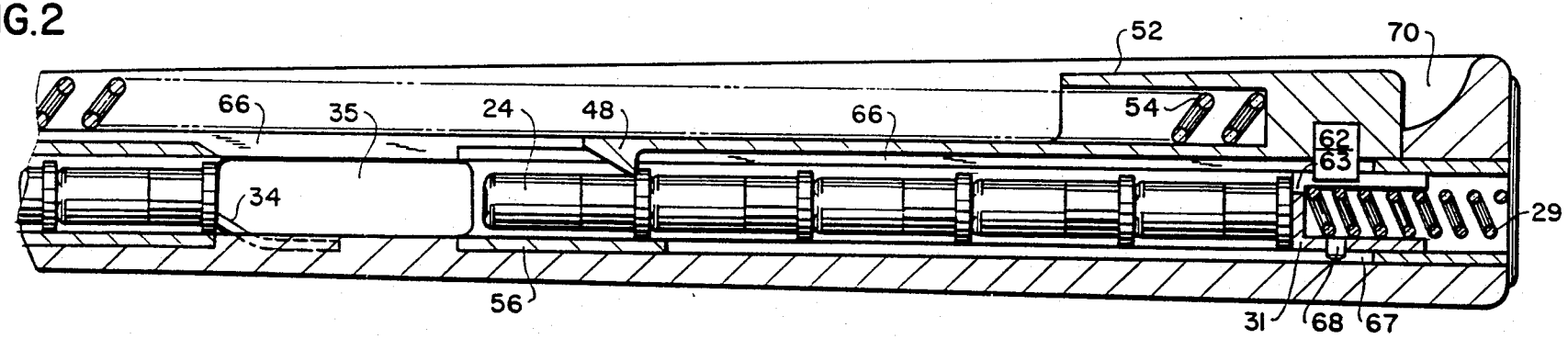
FIG. 2 shows a top cross sectional view of the configuration shown in FIG. 1

A center magazine section 32, shown in both FIG. 1 and FIG. 2, generally a tubular construction, being made in this embodiment as an integral part of the receiver 38, features an elongated opening 33 in the top to allow the loading of cartridges into the main magazine section 26 and into the auxiliary magazine section 44. The opening 33 is normally closed by a sliding cover 37 which is held toward the main magazine section 26 by a spring 27. The center magazine section 32 also comprises an opening 35 toward the barrel 42, bolt 40 and deflector 46 to allow access for the deflector 46 to reach into the path of the cartridge 24 as it exits under spring 28 pressure from the main magazine section 26. The function of the center magazine section 32 is to provide a connection and align the main magazine section 26 with the auxiliary magazine section 44, and to align the entire magazine 20 with the receiver 38.

An auxiliary magazine section 44 shown in FIG. 1 and detailed in FIG. 2 joining the center magazine section 32 and forming the upper part of the stock 60 in this embodiment.

The auxiliary magazine section 44 contains a tubular insert 56, and a spring 29 loaded cartridge follower 31 that urges the cartridges 24 toward the center magazine section 32. The cartridges 24 being stopped by a single or plurality of flexible abutments 48 of the charging handle 52. The charging handle 52 is being normally held toward the end of the auxiliary magazine section 44 by the spring 54.

The charging handle 52 return spring 54 is designed with sufficient power in its extended condition to overcome the power of the fully compressed spring 29 and to hold the handle 52 securely against the end of its travel.

The charging handle 52 rides in a recess 58 of the stock 60 and includes a pusher 62. The pusher 62 accesses the cartridges 24 through a slot 66. The follower 31 is constructed with a slot 63 that allow the follower 31 to move forward under spring 29 pressure clearing pusher 62 when there are no cartridges 24 in the auxiliary magazine section 44. Travel of follower 31 is limited by the slot 67 and the pin 68.

Conversely when the auxiliary magazine section 44 is only partially loaded, and the follower 31 is in an intermediate position, the slot 63 allows the pusher 62 to clear the follower 31 as it moves toward the main magazine section 26.

Figure 4:
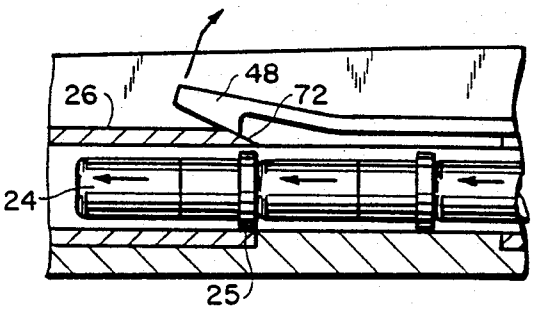
FIG. 3 and FIG. 4 show the detail of the first cartridge being transferred into the main magazine section.
Figure 3:
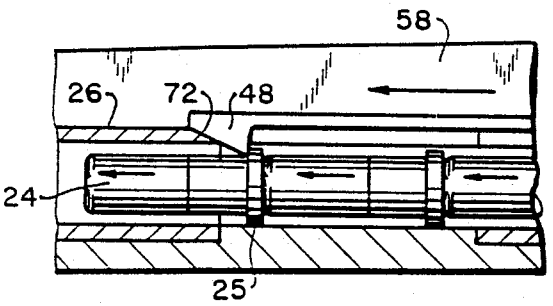

FIG. 3 shows the abutment 48 portion of the charging handle 52 as it contacts the cam surface 72 of the main magazine section 26. The abutment 48 is constructed as a flexible member of the charging handle 52 and upon contacting the cam surface 72, it moves out of the way of the cartridge rim 25 allowing the cartridge 24 to fully enter the main magazine section 26 as shown in FIG. 4.

Figure 5:
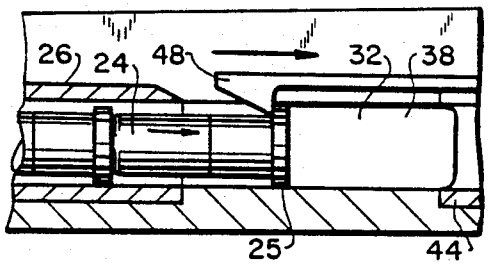
FIG. 5 shows the anti-jamming feature allowing the loading of partially filled magazines.

FIG. 5 shows how the abutment 48 portion of the charging handle 52 functions as an anti-jamming device. In absence of this feature jamming could occur if one or more of the cartridges 24 do not completely enter the main magazine section 26 due to either that the user attempts to reload a partially loaded main magazine section 26 or does not pushes the charging handle completely forward. As the user releases the charging handle 52, the return spring 54 will push the handle 52 back into the auxiliary magazine section 44. During this movement the abutment 48 portion of handle 52 will cam back toward the cartridge 24, catch rim 25 and transport all cartridges 24 that are outside of the main magazine section 26 back into the auxiliary magazine section 44.

The auxiliary magazine section 44 is closed on the external end by the buttplate 50 or other means to retain the spring 28.

Components described above are usually made of ordnance grade steel, high strength aluminum, and engineering plastics obvious to those skilled in the art of firearms.

Operation

The loading of this magazine 20 is accomplished by moving the sliding cover 37 toward the auxiliary magazine section 44 against spring 27 and pushing a plurality of cartridges 24 through the top opening 33 into the main magazine section 26 until it is filled to capacity. The cartridges are urged toward the center magazine section 32 by the spring 28 operated follower 30 but being contained in the main magazine section 26 by the retainers 34.

Loading of the auxiliary magazine section 44 is accomplished by pushing a plurality of cartridges 24 through the top opening 33 into the auxiliary magazine section 44 until it is filled to capacity. The cartridges 24 are being pushed into the auxiliary magazine section 44 with their primed casing ends first. The cartridges in this magazine section 44 are also urged toward the center section 32 by the spring 29 operated follower 31. The cartridges 24 being retained in the auxiliary magazine section 44 by the abutments 48 of the charging handle 52.

Upon completion of loading the cartridges 24 into the magazine 20 the user releases the sliding cover 37 which closes the opening 33 by the pressure of spring 27.

The user of the shotgun 22 charges the firing chamber 39 from the main magazine section 26 in a conventional manner. The bolt 40 is moved away from the firing chamber 39,and the deflector 46 which is commonly called carrier in the prior art is positioned into the center magazine section 32 by the shotgun 22 mechanism as shown in FIG. 1 with dotted lines. The retainers 34 released by the shotgun 22 mechanism to allow the spring 28 operated follower 30 to push one cartridge 24 out of the main magazine section 26 in a rapid movement. The deflector directs the cartridge 24 into a position between the bolt 40 and the firing chamber 39. As the bolt moves forward in the conventional manner, it pushes the cartridge 24 into the firing chamber 39.

Firing, ejection, and reloading of successive cartridges 24 from the main magazine section 26 is done in a conventional manner until the last cartridge 24 is fed from the main magazine section 26.

The main magazine section 26 will normally be reloaded from the auxiliary magazine section 44 before the last cartridge 24 placed into the firing chamber 39 from the main magazine section 26 is fired.

To recharge the main magazine section 26 from the auxiliary magazine section 44 the user places a finger into the recess 70 area of the stock 60 and applies a forward pressure on the charging handle 52 to move it in the direction of the main magazine section 26. The pusher 62 component of the charging handle 52 contacts the last cartridge 24 stored in the auxiliary magazine section 44 and moves the column of cartridges 24 toward the main magazine section 26.

During the continual forward movement the abutment 48 portion of the charging handle 52, being designed to be flexible, moves out of the way of the cartridge rim 25 upon contacting the cam surface 72 portion of the main magazine section 26 as shown in FIG. 3 and FIG. 4 allowing the column of cartridges to enter the main magazine section 26.

The transfer of cartridges 24 from the auxiliary magazine section 44 into the main magazine section 26 is accomplished by a single rapid forward movement of the hand.

Upon reaching the end of the travel of the charging handle 52 the user releases the handle 52 and the return spring 54 pushes the handle 52 back into the auxiliary magazine section 44.

The user normally would reload the the auxiliary magazine section 44 at this time. While the auxiliary magazine section 44 is being reloaded, the main magazine section 26 provides multiple cartridge 24 firing capability for the user.

The user also has the option to reload the auxiliary magazine section 44 after that the main magazine section 26 is emptied by continued firing. The user also has the option of reloading the magazine sections 26 and 44 any time, including while they are only partially empty.

If the main magazine section 26 is partially loaded when the user attempts to reload it from the auxiliary magazine section 44, one or more cartridges 24 will not fit into the main magazine section 26.

The above condition is illustrated in FIG. 5. As the operator releases or withdraws the charging handle 52, the abutment 48 cams back toward the cartridge 24 next to the main magazine section 26, catches the cartridge rim 25 and pull the cartridge 24 and all other cartridges 24 outside of the main magazine section 26 back into the auxiliary magazine section 44. This clearing action of the charging handle 52 abutment 48 assures that the center magazine section 32 is free of loose cartridges 24 and prevents the jamming of the shotgun 22.

OTHER EMBODIMENTS

Manually operated charging handle

Figure 6:
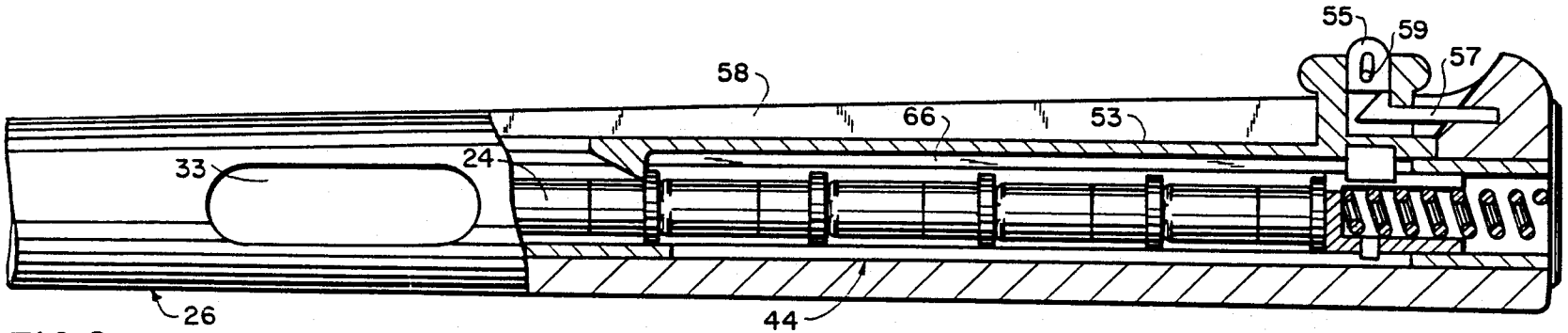
FIG. 6 shows an alternative embodiment with manually operated charging handle.

This embodiment is illustrated in FIG. 6.

Description

This embodiment shown in FIG. 6 differs from the preferred embodiment in the construction and operation of the charging handle. It includes all components of the preferred embodiment with the exception of the spring 54 and charging handle 52.

Additional functional components of this embodiment are the manually operated charging handle 53, the release button 55 and the catcher 57.

In the normal resting position the charging handle 53 is being retained in the rearmost position by the catcher 57 that is made of spring steel.

Operation

To transfer the cartridges 24 from the auxiliary magazine section 44 to the main magazine section 26 the user applies palm pressure on the release button 55 which in turn pushes the catch 57 out of engagement of the handle 53 effectively releasing handle 53 from its locked position. By pushing the handle 53 toward the main magazine section 26 the user transfers the cartridges 24 from the auxiliary magazine section 44 into the main magazine section 26. Upon reaching the end of the travel, the user pulls handle 53 back to its resting position to the end of the auxiliary magazine section 44. During the rearward movement the pressure of the palm is relaxed allowing the catcher 57 to enter the cavity of the operating handle 53. Snapping into engagement as shown in FIG. 6 the catcher 57 securely locks the handle 53 in its resting position.

The other construction and operating aspects of this embodiment are the same as the preferred embodiment.

Clip loadable configuration

Figure 7:
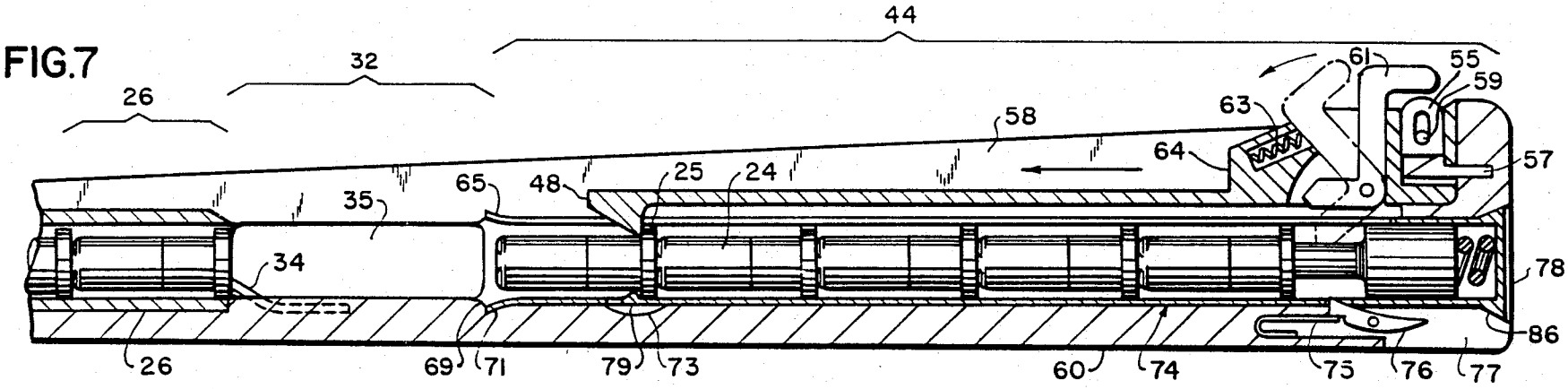
FIG. 7 shows a cross sectional view of a clip loadable firearm.
Figure 8:
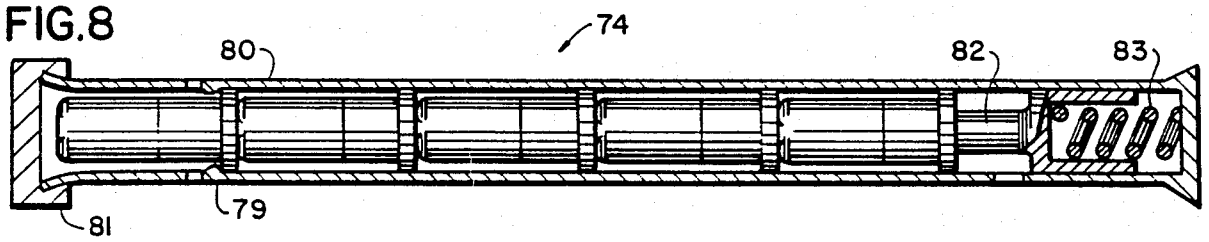
FIG. 8 and FIG. 9 shows a clip for a tubular magazine firearm.
Figure 9:
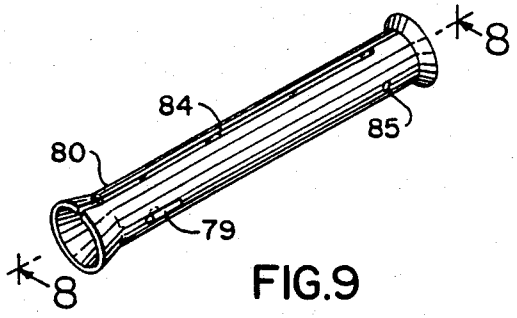

This embodiment is illustrated in FIG. 7, FIG. 8 and FIG. 9.

Description

This embodiment shown in FIG. 7 provides quick loading capability for a tubular magazine type firearm. The auxiliary magazine section 44 joining the center magazine section 32 and forms the upper part of the stock 60.

The auxiliary magazine section 44 is designed with a flared opening 78 at the end of the stock 60 to facilitate the insertion of the flared open end of the clip 74 containing a plurality of cartridges 24. The clip 74 is shown in FIG. 8 and FIG. 9. The clip 74 is retained in the auxiliary magazine section 44 by the spring 75 loaded catcher 76.

The charging handle 64 of this embodiment includes a spring 63 operated pivoting pusher 61, a release button 55 and a retainer pin 59. The stock 60 includes a catcher 57 made of spring steel.

The auxiliary magazine section 44 cavity contains a flared recess 71 to accommodate the flared end of the clip 74 and a recess 73 to accommodate the outward flexing of the retainer 79 component of the clip 74. The center magazine section 32 includes a flared recess 69 to facilitate the jam free movement of the cartridges 24 toward the main magazine section 26.

The clip 74 shown in detain in FIG. 8 comprises of a tubular housing 80 made of an engineering plastic type material, a cartridge follower 82 made of plastic, a steel spring 83 and a plastic cap 81.

The housing 80 contains a slot 84 which has two purposes. The slot 84 facilitates the housing 80 to be a tight fit over the cartridge rims 25 and allows the pusher 61 access the cartridges 24. The housing 80 also contains a molded in retainer 79 that prevents the cartridges 24 to fall out of the clip 74 when the cap 81 is removed by the user. This retainer 79 is flexible so the cartridges 24 can be advanced through them toward the main magazine section 26, and they flex out of the way to facilitate loading of cartridges 24 into the clip 74. The housing 80 also contains a hole 85 to retain the clip 74 in the auxiliary magazine section 44 by the clip catcher 76. The function of the pusher 82 and spring 83 is to hold the cartridges 24 in a column against the retainer 79 in the clip 74 assuring access of the pivoting pusher 61 to the rim 25 of the last cartridge 24 in the clip 74.

The cap 81 is flared internally to be securely snapped onto and remain on the housing 80 until the user removes it by force. The function of the cap 81 is to assure that the cartridges 24 are securely held in the clip 74 during handling and storage.

Operation

The user removes the cap 81 from the clip 74 and pushes a single or preferably a plurality of cartridges 24 into the housing 80 with the rimmed 25 ends first until the clip 74 is filled to capacity. The user than snaps the cap 81 onto the housing 80 if longer term storage of the clips 74 is desired.

To load the auxiliary magazine section 44, the user removes the cap 81 and pushes the clip 74 into the flared opening 78 of the auxiliary magazine section 44. Care should be taken to align the slot 84 with the charging handle 64 and its abutment 48. The clip 74 should be pushed into the auxiliary magazine section 44 until the clip catcher 76 snaps into the hole 85 of the clip 74. The auxiliary magazine section 44 is now loaded.

To transfer the cartridges into the main magazine section 26 the user pushes the top part of the pivoting pusher 61 toward the main magazine section 26. The pusher 61 pivots to its position shown by dotted lines in FIG. 7 and exposes the release button 55. By an inward push of the palm, the user puts pressure on the button 55 which in turn disengages the catcher 57 from the charging handle 64.

The continual forward motion of the hand will bring the pusher 61 into contact with the last cartridge 24 in the clip 74 and advances the cartridge 24 or column of cartridges 24 into the main magazine section 26. As the cartridge rims 25 passing the retainer 79, it flexes out of the way into the recess 73 provided for it.

Upon reaching the end of the stroke the user withdraws the charging handle 64, leaving the cartridges 24 secured in the main magazine section 26 by the retainers 34. The abutment 48 fulfills its jam clearing function the same way as it is described in the preferred embodiment. If the main magazine section 26 would be partially filled when the user attempts to reload it from the auxiliary magazine section 44 with a fresh clip 74 full of cartridges 24, the excess cartridges 24 will be pulled back into the clip 74 by the abutment 48.

Now, that the main magazine section 26 is loaded the user should replace the empty clip 74 with a new fully loaded clip 74 to secure maximum available firepower for the firearm. To replace the empty clip 74 the user places its thumb onto the clip catcher 76 in the thumb recess 77 of the stock 60, and by an inward pressure, disengages the catcher 76 from the hole 85 of the clip 74. In a continual motion while maintaining inward pressure by the thumb, the user pulls out the empty clip 74 by pulling with his thumb against the flared end 86 of the clip 74. The user then inserts a new fully loaded clip 74 into the auxiliary magazine 44.

The firearm is now fully loaded. The other construction and operating aspects of this embodiment are the same as the preferred embodiment.

Conclusion, Ramifications and Scope of Invention.

The reader will see that the invention provides a reliable and improved storage capacity magazine for firearms. The incorporation of this invention will particularly increase the firepower of shotguns for military and police applications.

The magazine is loadable in dark, it facilitates speed loading with a clip, and maintains firing capability of the firearm during reloading operations.

The use of the invention will also improve the controlability and recovery rate of the firearms, particularly shotguns, providing improved hit capability and rapidity of rate of fire.

While the preceding description contain many specificities, these should not be construed as limitations on the scope of the invention, but rather as an exemplification of a preferred and additional embodiments thereof. Many other variations are possible. For example the Center Feed Magazine can be constructed as an independent entity and attached to the receiver of a firearm. It can be constructed in numerous pieces attached independently to the receiver or stock of firearms. It can be constructed with a loading port for single cartridges at the rear end of the auxiliary magazine. It can be constructed that both the main and the auxiliary magazine having means to dispense cartridges alternatively or consecutively into the receiver of the firearm, or with other combination of features that are described in the various embodiments presented herein.

Skilled artisans will readily be able to change dimensions, shapes and construction materials of the various components described in the embodiments and adopt the invention to all types of firearms in addition to the shotgun.

Accordingly, the scope of the invention should be determined not by the embodiments illustrated, but by the appended claims and their legal equivalents.

I claim:

1. A tubular shotgun magazine having a longitudinally central area for feeding cartridges into a shotgun receiver comprising:

a main magazine section means providing storage means for a single or a plurality of said cartridges and a feeding means of said cartridges into said shotgun receiver;

a auxiliary magazine section means providing storage means for said cartridges and having means to transfer said cartridges into said main magazine section;

a connecting member means to substantially coaxially align and securely attach the magazine sections to each other and to said shotgun receiver.

2. The magazine of claim 1 further comprising:

a longitudinally centrally located loading means for said main magazine section and said auxiliary magazine section;

a transfer device means with anti jamming abutment means to clear said cartridges from said main magazine section when said cartridges are not fully inserted into said main magazine section.

3. A tubular shotgun magazine having a longitudinally central area for feeding cartridges into a shotgun receiver comprising:

a plurality of magazine section means arranged in a substantially coaxially aligned configuration located on opposite ends of said shotgun receiver having storage means for a single or a plurality of said cartridges and feeding means of said cartridges into said shotgun receiver either consecutively or alternatively from one or the other said magazine sections but never simultaneously from both of said magazine sections;

a connecting member means to substantially coaxially align and securely attach said plurality of magazine sections to each other and to said shotgun receiver.

4. The magazine of claim 3 further comprising:

a Longitudinally centrally located loading means for the plurality of magazine sections.

5. A cartridge clip comprising:

a flexible wall means defining a column space for receiving a single or a plurality of cartridges oriented axially in an end to end position;

a cartridge propelling means enclosed entirely within said flexible wall means, urging said cartridges toward a cartridge exit end of said clip;

a slot means formed in said flexible walls allowing access to said cartridges by a firearm cartridge feeding mechanism;

a cartridge retaining means formed into said flexible walls resisting the forces generated by said cartridge propelling means and retaining said cartridges within said clip; allowing passage of cartridges only when relieving forces applied on said cartridge retaining means by a firearm mechanism.

6. A cartridge clip of claim 5 further comprising:

a closure means secured on said cartridge exit end of said clip, being removable prior to or during insertion of said clip into said firearm.

* * * * *